US010306952B2

(12) United States Patent
Cheng

(10) Patent No.: US 10,306,952 B2
(45) Date of Patent: Jun. 4, 2019

(54) SURFACE BONDING FASTENER

(71) Applicant: Taiwan Paiho Limited, Chang Hwa Hsien (TW)

(72) Inventor: Allen Cheng, Chang Hwa Hsien (TW)

(73) Assignee: TAIWAN PAIHO LIMITED, Chang Hwa Hsien (TW)

( * ) Notice: Subject to any disclaimer, the term of this patent is extended or adjusted under 35 U.S.C. 154(b) by 0 days.

(21) Appl. No.: 15/343,293

(22) Filed: Nov. 4, 2016

(65) Prior Publication Data

US 2018/0008011 A1 Jan. 11, 2018

(30) Foreign Application Priority Data

Jul. 7, 2016 (TW) ..... 105121553 A

(51) Int. Cl.

| | |
|---|---|
| ***A44B 18/00*** | (2006.01) |
| ***B65D 33/00*** | (2006.01) |
| ***B65D 33/24*** | (2006.01) |

(52) U.S. Cl.

CPC ..... *A44B 18/0061* (2013.01); *A44B 18/0049* (2013.01); *B65D 33/00* (2013.01); *B65D 33/24* (2013.01)

(58) Field of Classification Search

CPC .. A44B 18/0061; A44B 18/0049; A44B 13/00
See application file for complete search history.

(56) References Cited

U.S. PATENT DOCUMENTS

| | | | |
|---|---|---|---|
| 5,067,210 | A | 11/1991 | Kayaki |
| 5,537,720 | A | 7/1996 | Takizawa et al. |
| 5,625,930 | A | 5/1997 | Takizawa et al. |

(Continued)

FOREIGN PATENT DOCUMENTS

| | | | |
|---|---|---|---|
| CN | 1325280 | A | 12/2001 |
| CN | 2636673 | Y | 9/2004 |

(Continued)

OTHER PUBLICATIONS

Office Action dated Dec. 7, 2016 in corresponding Taiwanese Application No. 105121553 (Search Report included) with English translation.

(Continued)

*Primary Examiner* — Robert Sandy
*Assistant Examiner* — David M Upchurch
(74) *Attorney, Agent, or Firm* — Bacon & Thomas, PLLC

(57) ABSTRACT

A surface bonding fastener includes first and second members that can be fastened with each other. Each of the first and second members includes a base sheet and a plurality of fastening units on and integrally molded with the base sheet. Each of the fastening units has first and second hooks. The first hook has a first body and a first hook portion. The second hook has a second body and a second hook portion. The first and second bodies are adjacent to each other in a transverse direction and integrally formed on the base sheet. The first and second hook portions are respectively extend from the first and second bodies and bended toward opposite directions. An overlapping degree between the first and second bodies in a longitudinal direction is configured to be determined by a desired fastening strength between the first and second members.

3 Claims, 7 Drawing Sheets

(56) References Cited

U.S. PATENT DOCUMENTS

| | | | | | |
|---|---|---|---|---|---|
| 5,664,301 | A * | 9/1997 | Akeno | A44B 18/0061 | 24/442 |
| 5,755,015 | A * | 5/1998 | Akeno | A44B 18/0049 | 24/442 |
| 5,755,016 | A * | 5/1998 | Provost | A44B 18/0061 | 24/442 |
| 5,860,194 | A * | 1/1999 | Takizawa | A44B 18/0046 | 24/390 |
| RE36,779 | E * | 7/2000 | Takizawa | A44B 18/0061 | 24/452 |
| 6,357,088 | B2 * | 3/2002 | Provost | A44B 18/0049 | 24/304 |
| 7,048,984 | B2 | 5/2006 | Seth et al. | | |
| 7,841,052 | B2 * | 11/2010 | Ducauchuis | A44B 18/0053 | 24/452 |
| 8,225,467 | B2 * | 7/2012 | Gallant | A44B 18/0053 | 24/450 |
| 8,273,102 | B2 * | 9/2012 | Danitz | A61B 17/122 | 606/207 |
| 8,424,172 | B2 * | 4/2013 | Idrizovic | A44B 18/0061 | 24/452 |
| 8,858,077 | B2 * | 10/2014 | Shepard | B65D 31/10 | 383/203 |
| 2001/0022012 | A1 | 9/2001 | Shepard et al. | | |
| 2007/0022580 | A1 | 2/2007 | Ducauchuis | | |
| 2007/0240289 | A1 | 10/2007 | Murasaki et al. | | |
| 2009/0010735 | A1 * | 1/2009 | Gallant | A44B 18/0053 | 411/510 |
| 2009/0064469 | A1 | 3/2009 | Dowd | | |
| 2011/0249919 | A1 | 10/2011 | Shepard | | |
| 2012/0042483 | A1 | 2/2012 | Cheng | | |

FOREIGN PATENT DOCUMENTS

| | | | |
|---|---|---|---|
| CN | 1903096 | A | 1/2007 |
| CN | 102947192 | A | 2/2013 |
| EP | 1669000 | B1 | 1/2010 |
| JP | 2007-038002 | A | 2/2007 |
| KR | 10-0165153 | B1 | 1/1999 |
| TW | 201302480 | A | 1/2013 |
| WO | 2004/058584 | A2 | 7/2004 |

OTHER PUBLICATIONS

Australian Examination Report of Australian Patent Application No. 2016259338 dated Oct. 25, 2017.

European Search Report of European Patent Application No. 16198504.9 dated May 15, 2017.

Korean Office Action of Korean Patent Application No. 10-2016-0169706 dated Jan. 31, 2018.

Australia Examination Report No. 2 of Australia Patent Application No. 2016259338 dated Feb. 8, 2018.

First Office Action of corresponding Chinese Patent Application No. 201610529988.X dated Aug. 28, 2018.

* cited by examiner

SURFACE BONDING FASTENER

BACKGROUND OF INVENTION

1. Field of Invention

The present invention relates to a surface bonding fastener, especially to a surface bonding fastener applied for a package, which has hooks that are engageable with each other.

2. Related Prior Art

The well-known surface bonding fastener applied for a package (e.g., a zipper bag) mainly uses plastic concave-convex strips respectively disposed near an opening of the package and extending in a transverse direction to achieve a purpose of repeatedly opening and closing the opening of the package. In this regard, however, during using this surface bonding fastener repeatedly, since force applied thereto are not uniform, such type of surface bonding fastener may have problems such as different degrees of closing of the opening, different force required for opening the package and the like.

Moreover, since the field to which this type of surface bonding fastener applied becomes wider and wider, and the concerned point is not only focused on the single airtight function. For example, when this type of surface bonding fastener is applied to the package, such as feed bag, one purpose thereof is to discharge remaining air in the package in order to reduce the volume of the package so as to achieve purposes of easy storage and carrying. Thus, many different types of surface bonding fasteners had been proposed.

A surface bonding fastener which utilizes the injection molding hooks and the cooperated loop surface to achieve the bonding purpose had been proposed. However, it required a manufacturing process different from a manufacturing process of the package to manufacture the loop surface in such surface bonding fastener, whereby the package having such surface bonding fastener is difficult to be manufactured. Moreover, while the package is opened and closed repeatedly, parts of the loop surface will come off due to the repeatedly opening and closing and generate crumbs that may contaminate the objects contained in the package.

U.S. Pat. No. 8,858,077B2 had proposed another surface bonding fastener which utilizes the injection molding hooks that are continuously engaged with each other. Such surface bonding fastener has a plurality of rows of longitudinally extending injection molding hooks that are arranged in the transverse direction and formed near the opening of the package, such that it can achieve the bonding effect by the mutual engagements of these injection molding hooks. However, since the hook portions of these injection molding hooks in this type of surface bonding fastener are bended toward the same direction, the misplacement is easily to occur between the rows during the mutual engagement so as to cause the inconvenience of using.

U.S. Pat. No. 7,841,052B2 had also proposed a surface bonding fastener which utilizes the injection molding hooks that are continuously engaged with each other, and uses the mutual engagements of the plurality of rows of the injection molding hooks to achieve the bonding effect, wherein the plurality of rows of the injection molding hooks have different numbers of hook portions bended toward opposite directions. However, the arrangement of the injection molding hooks in this type of surface bonding fastener is very complicated, and the hook portions of the some injection molding hooks cannot be engaged with the other hook portions, such that the manufacturing cost of this surface bonding fastener is high and it is hard to the user to align the injection molding hooks during using this surface bonding fastener.

Accordingly, for the fastener by virtue of continuous engagements between injection molding hooks, shape, density, interaction between hook portions and the like of the injection molding hooks become factors affecting the bonding effect.

In view of above, since the conventional surface bonding fasteners have the above-mentioned drawbacks, it motivates the inventor of the present invention to research and develop an improved surface bonding fastener that is advantageous with respect to the conventional surface bonding fasteners as previously described.

SUMMARY OF INVENTION

One object of the present invention is to provide a surface bonding fastener of which hooks are configured to be engaged with each other, and such surface bonding fastener can be applied to a package for opening and closing an opening of the package.

The present invention provides a surface bonding fastener comprising a first member and a second member that can be fastened with each other. Each of the first member and the second member comprises a base sheet and a plurality of fastening units on and integrally molded with the base sheet. The plurality of fastening units are arranged at intervals in a longitudinal direction, and are staggered in a transverse direction perpendicular to the longitudinal direction. Each of the fastening unit has a first hook and a second hook. The first hook has a first body extending from the base sheet, and a first hook portion extending from the first body and bended toward a first direction. The second hook has a second body extending from the base sheet, and a second hook portion extending from the second body and bended toward a second direction opposite to the first direction. The second body is adjacent to the first body in the transverse direction and integrally formed with the first body. The first body and the second body at least partly overlap with each other in the longitudinal direction, and an overlapping degree therebetween is configured to be determined based on a desired fastening strength between the first member and the second member. When the first member and the second member are fastened with each other, the first hook portions of the first member are configured to be engaged with the first hook portions of the second member, and the second hook portions of the first member are configured to be engaged with the second hook portions of the second member.

Preferably, the surface bonding fastener according to the present invention can be configured such that a transverse spacing between the two adjacent fastening units in the transverse direction is smaller than or equal to a transverse length of the fastening unit in the transverse direction.

Preferably, the surface bonding fastener according to the present invention can be configured such that a longitudinal spacing between the two adjacent fastening units in the longitudinal direction is smaller than a longitudinal length of the fastening unit in the longitudinal direction.

Further features and advantages of the present invention will become apparent after reviewing the following detailed descriptions and the accompanying drawings of the present invention.

DETAILED DESCRIPTION OF PREFERRED EMBODIMENT

Figure 1:
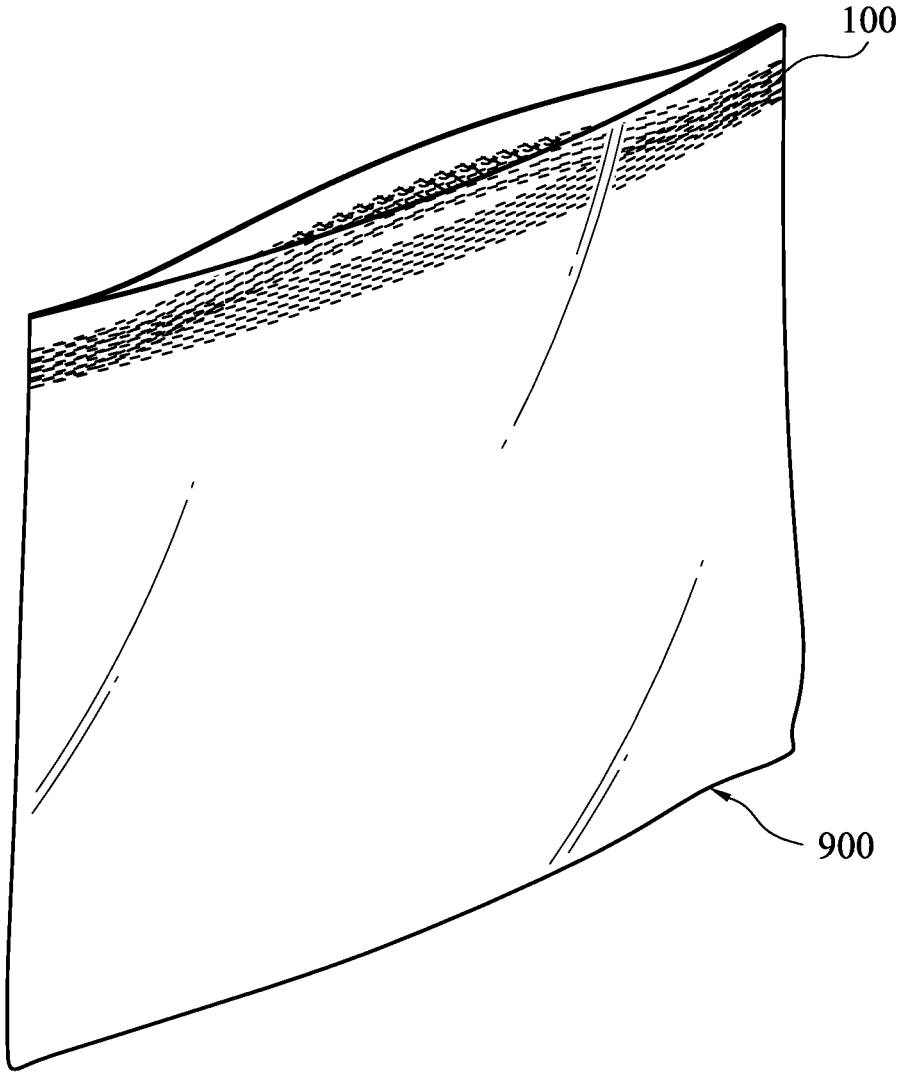
FIG. 1 is a schematic view of a zipper bag which utilizes a surface bonding fastener in accordance with the present invention.

FIG. 1 illustrates a zipper bag 900 which utilizes a surface bonding fastener in accordance with the present invention. As shown in FIG. 1, the surface bonding fastener 100 is provided at a vicinity of an opening of the zipper bag 900 for opening and closing the opening of the zipper bag 900. Details of the surface bonding fastener 100 can refer to the surface bonding fastener according to a first embodiment of the present invention that is described with reference to FIGS. 2 to 4.

Figure 2:
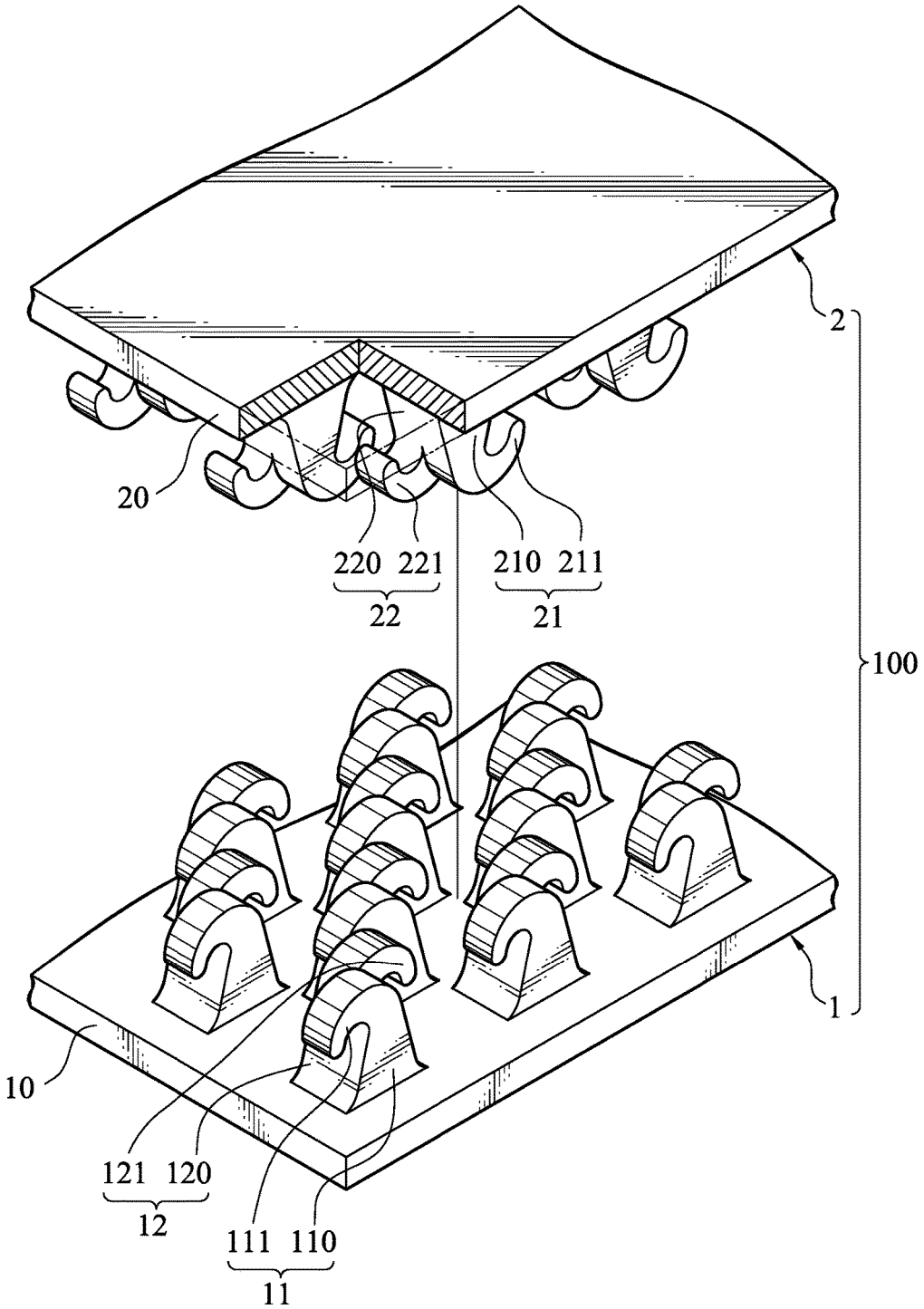
FIG. 2 is a schematic exploded perspective view of a surface bonding fastener in accordance with a first embodiment of the present invention.

As shown in FIG. 2, the surface bonding fastener 100 in accordance with the first embodiment of the present invention comprises a first member 1 and a second member 2 that can be fastened with each other. The first member 1 includes a base sheet 10 and a plurality of fastening units A on and integrally molded with the base sheet 10. The plurality of fastening units A are arranged at intervals in a longitudinal direction MD, and are staggered in a transverse direction CD (referring to FIG. 3). Similar to the first member 1, the second member 2 includes a base sheet 20 and a plurality of fastening units on and integrally molded with the base sheet 20. In the following descriptions, since the fastening units of the second member 2 are formed on the base sheet 20 by the same way as that of the fastening units A of the first member 1, parts of the descriptions of the fastening units of the second member 2 are omitted for the sake of simplicity.

Next, the fastening units of the surface bonding fastener 100 of the first embodiment will be described in detail with reference to FIGS. 2 and 3.

As shown in FIG. 2, each of the fastening units A of the first member 1 includes a first hook 11 and a second hook 12. The first hook 11 has a first body 110 extending from the base sheet 10, and a first hook portion 111 extending from the first body 110 and bended toward a first direction. The second hook 12 has a second body 120 extending from the base sheet 10, and a second hook portion 121 extending from the second body 120 and bended toward a second direction opposite to the first direction. The second body 120 of the second hook 12 is adjacent to the first body 110 of the first hook 11 in the transverse direction CD and integrally formed with the first body 110 of the first hook 11.

Similarly, as shown in FIG. 2, each of the fastening units of the second member 2 includes a first hook 21 and a second hook 22. The first hook 21 has a first body 210 extending from the base sheet 20, and a first hook portion 211 extending from the first body 210 and bended toward a first direction. The second hook 22 has a second body 220 extending from the base sheet 20, and a second hook portion 221 extending from the second body 220 and bended toward a second direction opposite to the first direction. The second body 220 of the second hook 22 is adjacent to the first body 210 of the first hook 21 in the transverse direction CD and integrally formed with the first body 210 of the first hook 21.

Figure 3:
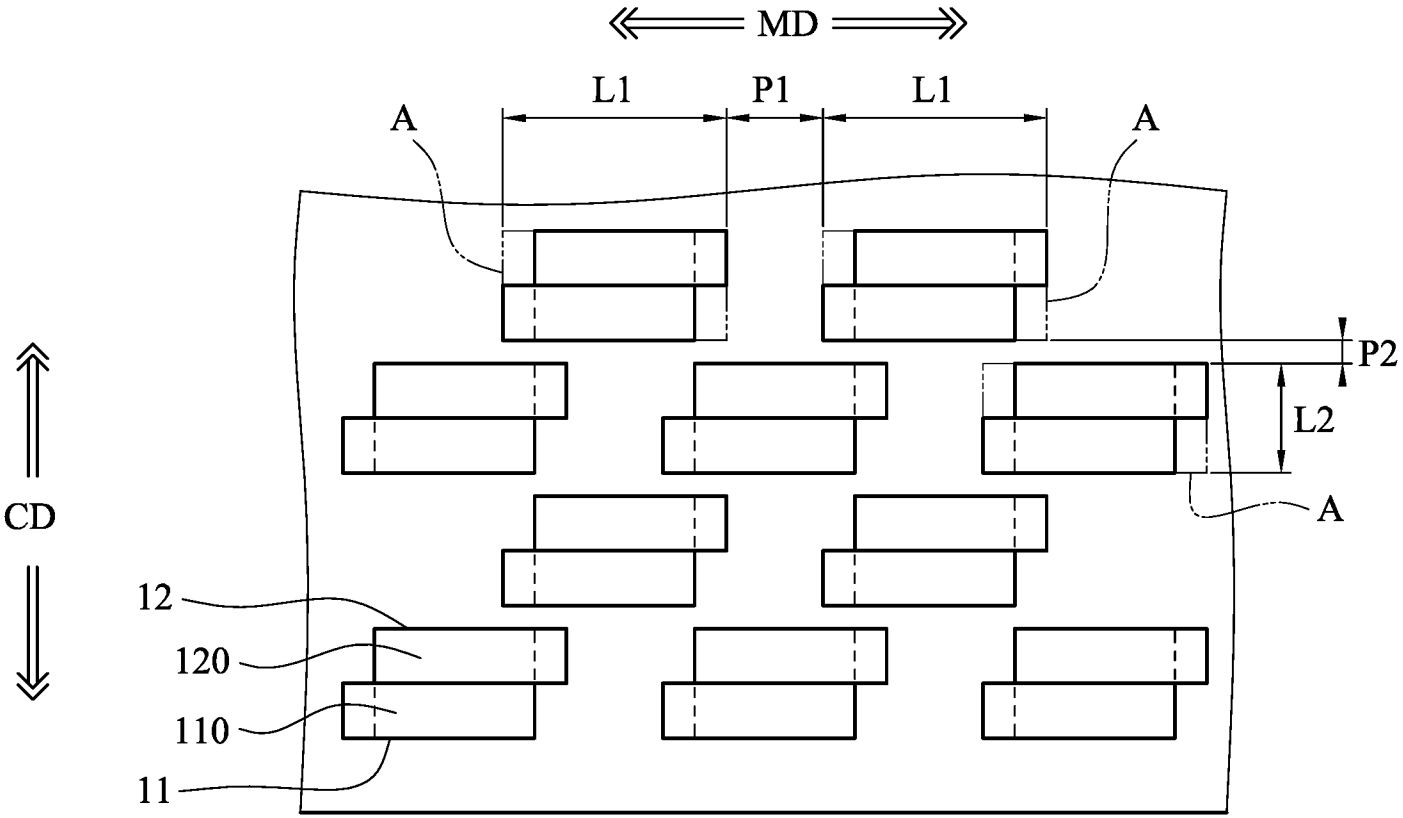
FIG. 3 is a schematic view showing an arrangement of fastening units of the surface bonding fastener in accordance with the first embodiment of the present invention.

Next, as shown in FIG. 3, the first body 110 and the second body 120 of each fastening unit A are arranged to overlap with each other in the longitudinal direction MD. Moreover, the surface bonding fastener in accordance with the first embodiment of the present invention is configured such that a longitudinal spacing P1 between the two adjacent fastening units A in the longitudinal direction MD is smaller than a longitudinal length L1 of the fastening unit A (one fastening unit A) in the longitudinal direction MD. And, the surface bonding fastener in accordance with the first embodiment of the present invention is also configured such that a transverse spacing P2 between the two adjacent fastening units A in the transverse direction CD is smaller than a transverse length L2 of the fastening unit A in the transverse direction CD.

Please note that, in the drawings illustrating the present embodiment, although the transverse spacing P2 between the two adjacent fastening units A is smaller than the transverse length L2 of the fastening unit A, yet the transverse spacing P2 between the two adjacent fastening units A can also be set as being equal to the transverse length L2 of the fastening unit A.

A state in which the first member 1 and the second member 2 of the surface bonding fastener 100 in accordance with the first embodiment of the present invention are fastened together will be described below with reference to FIG. 4.

Figure 4:
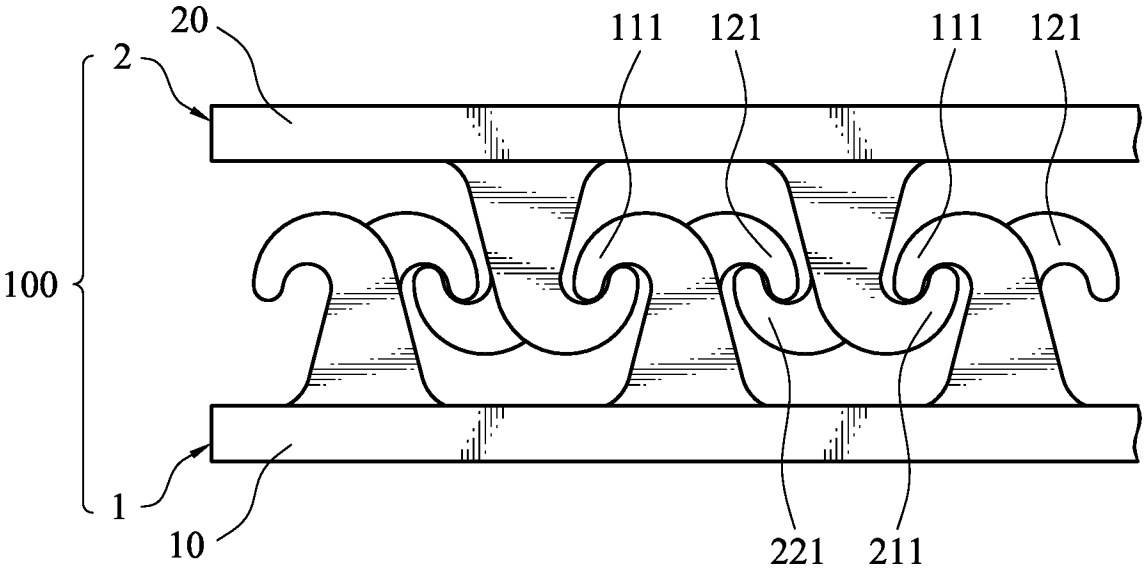
FIG. 4 is a schematic front view of the surface bonding fastener in accordance with the first embodiment of the present invention, showing that the surface bonding fastener is in a bonding state.

As shown in FIG. 4, when the first member 1 and the second member 2 are fastened together, the first hook portions 111 in the first member 1 are configured to be engaged with the first hook portions 211 in the second member 2, and the second hook portions 121 in the first member 1 are configured to be engaged with the second hook portions 221 in the second member 2.

Accordingly, in accordance with the first embodiment of the present invention, since the first hook portion and the second hook portion of each of the fastening units are bended toward the opposite directions, due to this directional relationship, the first hook portions of the first member can only be engaged with the first hook portions of the second member and cannot be engaged with the second hook portions of the second member. Thus, while the first member and the second member are fastener with each other, it is possible to avoid the misalignment to occur in the transverse direction.

In addition to avoiding the misalignment to occur in the transverse direction as mentioned above, when the surface bonding fastener in accordance with the first embodiment of the present invention is utilized to the zipper bag as shown in FIG. 1 (that is, the first member and the second member are two opposite bag bodies of the zipper bag, and the plurality of fastening units included in each of the first member and the second member are formed at a vicinity of the opening of the zipper bag), since the fastening units (the first hooks and the second hooks) of the present invention are integrally molded with the base sheet, the first member and the second member that can be fastened together can be easily manufactured in the same manufacturing process without needing additional manufacturing process for forming the fastening units on the base sheet. Then, the zipper bag having the reclosable opening can be manufactured after subjecting the subsequent manufacturing processes. Moreover, in addition to the function that the opening can be repeatedly opened and closed, the zipper bag formed from the surface bonding fastener in accordance with the first embodiment of the present invention further has a function of discharging the remaining air therein since the plurality of fastening units included in each of the first member and the second member are arranged at intervals with spacing existing therebetween.

A surface bonding fastener 500 in accordance with a second embodiment of the present invention will be described with reference to FIGS. 5 to 7.

Figure 5:
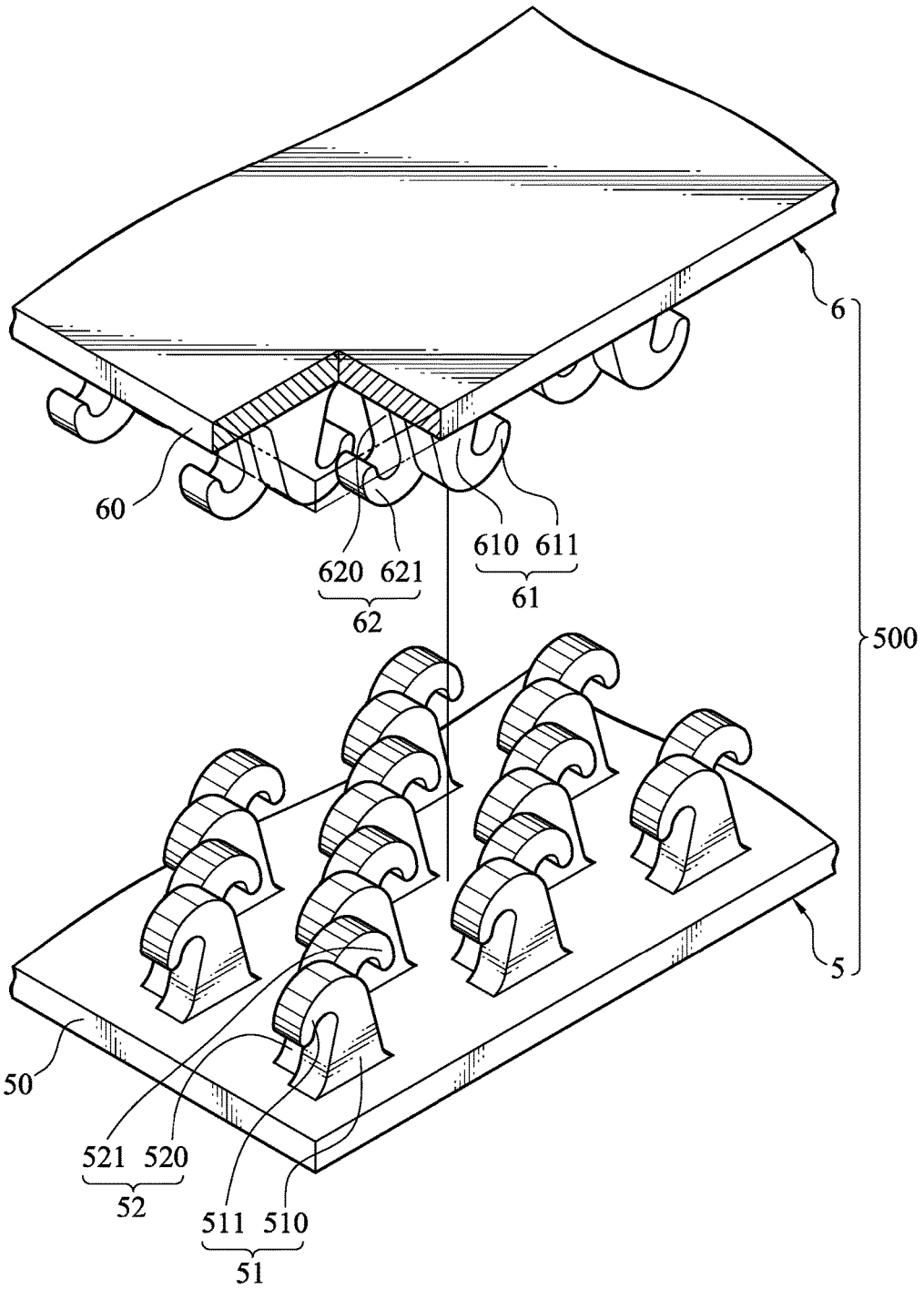
FIG. 5 is a schematic exploded perspective view of a surface bonding fastener in accordance with a second embodiment of the present invention.

As shown in FIG. 5, the surface bonding fastener 500 in accordance with the second embodiment of the present invention comprises a first member 5 and a second member 6 that can be fastened with each other. The first member 5 includes a base sheet 50 and a plurality of fastening units B on and integrally molded with the base sheet 50. The plurality of fastening units B are arranged at intervals in a longitudinal direction MD, and are staggered in a transverse direction CD (referring to FIG. 6). Similar to the first member 5, the second member 6 includes a base sheet 60 and a plurality of fastening units on and integrally molded with the base sheet 60. In the following descriptions, since the fastening units of the second member 6 are formed on the base sheet 60 by the same way as that of the fastening units B of the first member 5, parts of the descriptions of the fastening units of the second member 6 are omitted for the sake of simplicity.

Next, the fastening units of the surface bonding fastener 500 of the second embodiment will be described in detail with reference to FIGS. 5 and 6.

As shown in FIG. 5, each of the fastening units B of the first member 5 includes a first hook 51 and a second hook 52. The first hook 51 has a first body 510 extending from the base sheet 50, and a first hook portion 511 extending from the first body 510 and bended toward a first direction. The second hook 52 has a second body 520 extending from the base sheet 50, and a second hook portion 521 extending from the second body 520 and bended toward a second direction opposite to the first direction. The second body 520 of the second hook 52 is directly adjacent to and in contact with the first body 510 of the first hook 51 in the transverse direction CD and integrally formed with the first body 510 of the first hook 51.

Similarly, as shown in FIG. 5, each of the fastening units of the second member 6 includes a first hook 61 and a second hook 62. The first hook 61 of the second member 6 has a first body 610 extending from the base sheet 60, and a first hook portion 611 extending from the first body 610 and bended toward a first direction. The second hook 62 of the second member 6 has a second body 620 extending from the base sheet 60, and a second hook portion 621 extending from the second body 620 and bended toward a second direction opposite to the first direction. The second body 620 of the second hook 62 is adjacent to the first body 610 of the first hook 61 in the transverse direction CD and integrally formed with the first body 610 of the first hook 61.

Figure 6:
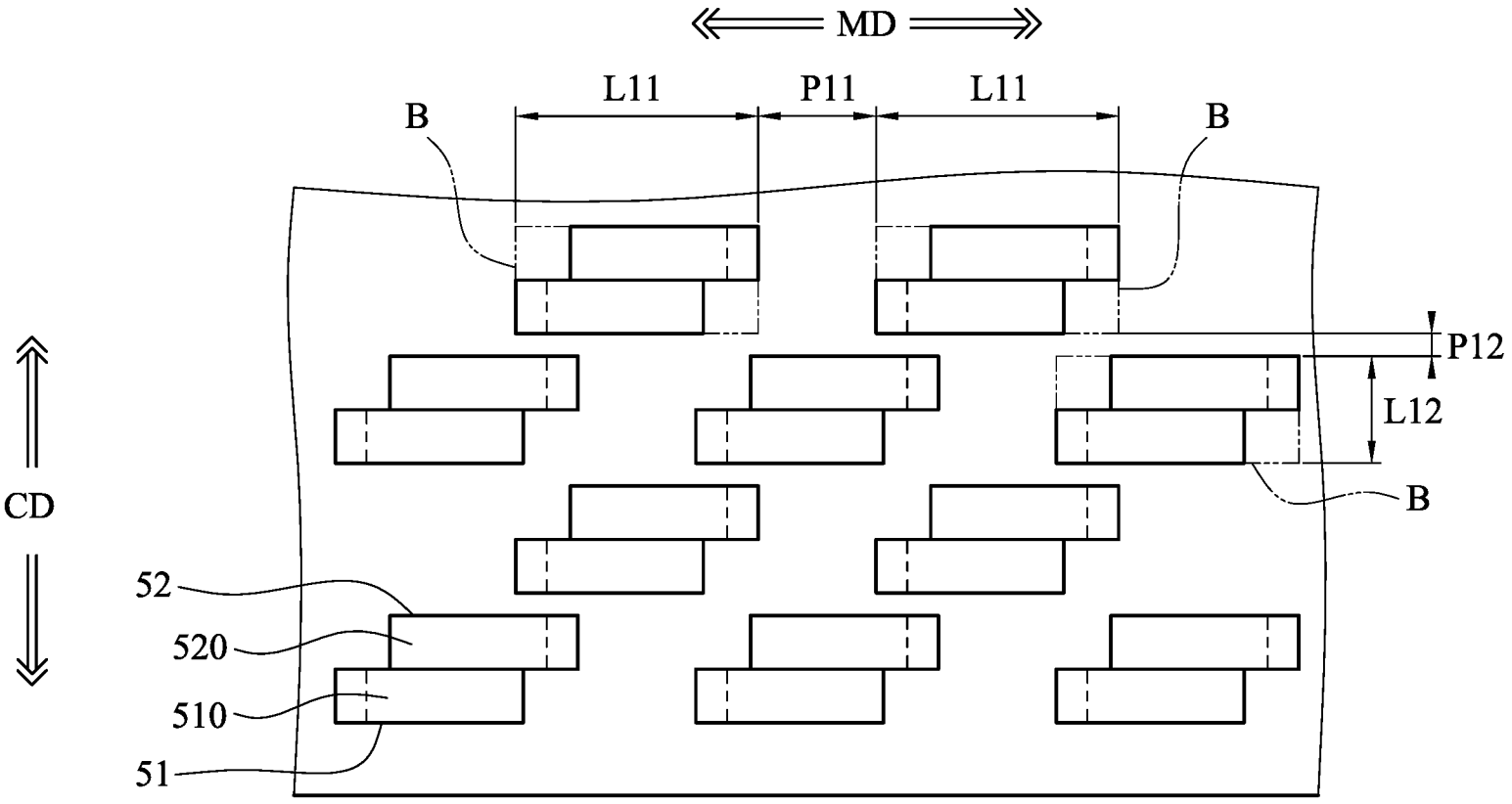
FIG. 6 is a schematic view showing an arrangement of fastening units of the surface bonding fastener in accordance with the second embodiment of the present invention.

Next, as shown in FIG. 6, the first body 510 and the second body 520 of each fastening unit B are arranged to partly overlap with each other in the longitudinal direction MD. That is, the first body 510 and the second body 520 of each fastening unit B are configured to offset with each other by a distance toward opposite directions along the longitudinal direction MD, and this distance is determined based on a desired fastening strength between the first member and the second member of the surface bonding fastener. Moreover, also referring to FIG. 6, the surface bonding fastener in accordance with the second embodiment of the present invention is configured such that a longitudinal spacing P11 between the two adjacent fastening units B in the longitudinal direction MD is smaller than a longitudinal length L11 of the fastening unit B (one fastening unit B) in the longitudinal direction MD. And, the surface bonding fastener in accordance with the second embodiment of the present invention is further configured such that a transverse spacing P12 between the two adjacent fastening units B in the transverse direction CD is smaller than a transverse length L12 of the fastening unit B in the transverse direction CD.

Please note that, in the drawings illustrating the present embodiment, although the transverse spacing P12 between the two adjacent fastening units B is smaller than the transverse length L12 of the fastening unit B, yet the transverse spacing P12 between the two adjacent fastening units B can also be set as being equal to the transverse length L12 of the fastening unit B.

A state in which the first member 5 and the second member 6 of the surface bonding fastener 500 in accordance with the second embodiment of the present invention are fastened together will be described below with reference to FIG. 7.

Figure 7:
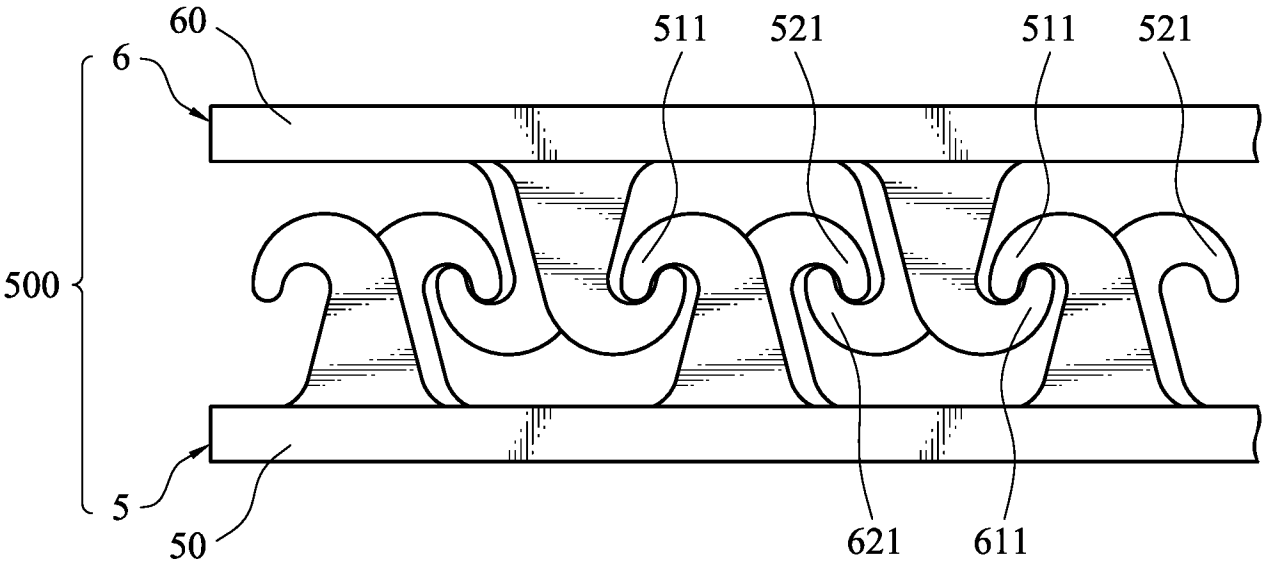
FIG. 7 is a schematic front view of the surface bonding fastener in accordance with the second embodiment of the present invention, showing that the surface bonding fastener is in a bonding state.

As shown in FIG. 7, when the first member 5 and the second member 6 are fastened together, the first hook portions 511 in the first member 5 are configured to be engaged with the first hook portions 611 in the second member 6, and the second hook portions 521 in the first member 5 are configured to be engaged with the second hook portions 621 in the second member 6.

Accordingly, as comparing to the surface bonding fastener of the first embodiment of the present invention, in a case that the fastening units of the surface bonding fastener of the second embodiment of the present invention are arranged with the same spacing (the transverse spacing and the longitudinal spacing) therebetween as that of the fastening units of the surface bonding fastener of the first embodiment of the present invention, since the first body and the second body in each of the fastening units of the second embodiment of the present invention are arranged to partly overlap with each other in the longitudinal direction (that is, the first body and the second body offset with each other toward opposite directions along the longitudinal direction), in the range having the same size of the first member and the second member, amounts of the fastening units in the longitudinal direction included in the surface bonding fastener of the second embodiment of the present invention is less than amounts of the fastening units in the longitudinal direction included in the surface bonding fastener of the first embodiment of the present invention. In such case, the fastening strength between the first member and the second member of the surface bonding fastener of the second embodiment of the present invention is weaker than the fastening strength between the first member and the second member of the surface bonding fastener of the first embodiment of the present invention. Thus, the surface bonding fastener of the second embodiment of the present invention can be utilized to some package of which the desired fastening strength is weaker. In contrast, the surface bonding fastener of the first embodiment of the present invention can be utilized to some package of which the desired fastening strength is stronger.

In view of above, the abovementioned embodiments of the present invention reveal that an overlapping degree between the first body and the second body in the longitudinal direction is determined based on the desired fastening strength between the first member and the second member of the surface bonding fastener (i.e., the desired fastening strength of the package).

Moreover, similar to the first embodiment of the present invention, since each of the fastening units in the second embodiment of the present invention has the first hook portion and the second hook portion that are bended toward the opposite directions, it is less likely to occur the misalignment in the transverse direction while the first member and the second member are fastened with each other.

In addition to avoiding the misalignment to occur in the transverse direction as mentioned above, similar to the surface bonding fastener in accordance with the first embodiment of the present invention, in the surface bonding fastener in accordance with the second embodiment of the present invention, the first member and the second member each of which includes the base sheet and the fastening units integrally molded with the base sheet can be easily manufactured by the same manufacturing process. Then, the zipper bag having the reclosable opening can be manufactured after subjecting the subsequent manufacturing processes. In other words, the surface bonding fastener in accordance with the second embodiment of the present invention can also be utilized to the zipper bag as shown in FIG. 1. Moreover, similar to the surface bonding fastener in accordance with the first embodiment of the present invention, the zipper bag formed from the surface bonding fastener in accordance with the second embodiment of the present invention also has a function of discharging the remaining air therein due to the spacing existing between the plurality of fastening units thereof.

Although in the abovementioned descriptions, the surface bonding fasteners of the first embodiment and the second embodiment of the present invention are described with being utilized to the zipper bag shown in FIG. 1 as examples, yet it should be understood that, the surface bonding fasteners of the first embodiment and the second embodiment of the present invention can also be utilized to the package other than the zipper bag.

Although the several aspects of the present invention have been described in the abovementioned embodiments with reference to the accompanying drawings, such embodiments merely are the preferred embodiments of the present invention and are not intended to limit the scopes of the present invention into the specific features and structures as illustrated in the abovementioned descriptions and the accompanying drawings. A person skilled in the art of the present invention can envisage various changes and modifications within the spirit of the present invention, and such changes and modifications are also included in the scopes of the present invention.

The invention claimed is:

1. A surface bonding fastener, comprising:

first and second members capable of being fastened with each other, each of the first and second members comprising:

a base sheet; and a plurality of fastening units on and integrally molded with the base sheet, the plurality of fastening units arranged at intervals in a longitudinal direction and staggered in a transverse direction perpendicular to the longitudinal direction, each of the plurality of fastening units comprising:

a first hook having a first body extending from the base sheet and a first hook portion extending from the first body and bended toward a first direction; and a second hook having a second body extending from the base sheet and a second hook portion extending from the second body and bended toward a second direction opposite to the first direction, wherein the second body is directly adjacent to and in contact with the first body in the transverse direction and integrally formed with the first body, wherein the first body and the second body only partly overlap with each other in the longitudinal direction at a position where the first body and the second body are connected with the base sheet, and an overlapping degree between the first body and the second body in the longitudinal direction is configured to be determined based on a desired fastening strength between the first member and the second member, and wherein when the first member and the second member are fastened with each other, the first hook portions of the first member are configured to be engaged with the first hook portions of the second member, and the second hook portions of the first member are configured to be engaged with the second hook portions of the second member.

2. The surface bonding fastener of claim 1, wherein a transverse spacing between the two adjacent fastening units in the transverse direction is smaller than or equal to a transverse length of the fastening unit in the transverse direction.

3. The surface bonding fastener of claim 1, wherein a longitudinal spacing between the two adjacent fastening units in the longitudinal direction is smaller than a longitudinal length of the fastening unit in the longitudinal direction.

* * * * *